US008269432B2

(12) United States Patent
Yang et al.

(10) Patent No.: US 8,269,432 B2
(45) Date of Patent: Sep. 18, 2012

(54) OFFLINE LED LIGHTING CIRCUIT WITH DIMMING CONTROL

(75) Inventors: Ta-Yung Yang, Milpitas, CA (US); Chien-Yuan Lin, Taipei County (TW); Chien-Tung Lan, Taipei (TW)

(73) Assignee: System General Corporation, Sindian, Taipei County (TW)

( * ) Notice: Subject to any disclaimer, the term of this patent is extended or adjusted under 35 U.S.C. 154(b) by 413 days.

(21) Appl. No.: 12/769,728

(22) Filed: Apr. 29, 2010

(65) Prior Publication Data

US 2011/0062877 A1 Mar. 17, 2011

Related U.S. Application Data

(60) Provisional application No. 61/276,676, filed on Sep. 14, 2009.

(51) Int. Cl.
*G05F 1/00* (2006.01)

(52) U.S. Cl. ..... 315/308; 315/209 R; 315/177; 315/291

(58) Field of Classification Search ..... 315/119, 315/121, 122, 127, 177, 185 R, 186, 193, 315/200 R, 201, 206, 209 R, 210, 212, 217, 315/219, 224, 225, 291, 297, 299, 300, 301, 315/302, 306, 307, 308, 312, 313, 361, 362
See application file for complete search history.

(56) References Cited

U.S. PATENT DOCUMENTS

| | | | | |
|---|---|---|---|---|
| 6,611,439 | B1 * | 8/2003 | Yang et al. | 363/41 |
| 6,977,824 | B1 * | 12/2005 | Yang et al. | 363/21.16 |
| 7,145,295 | B1 * | 12/2006 | Lee et al. | 315/291 |
| 7,362,592 | B2 * | 4/2008 | Yang et al. | 363/21.13 |
| 7,414,865 | B2 * | 8/2008 | Yang | 363/21.16 |
| 8,031,492 | B2 * | 10/2011 | Lin et al. | 363/21.18 |
| 2007/0121352 | A1 * | 5/2007 | Yang et al. | 363/21.15 |
| 2009/0237007 | A1 * | 9/2009 | Leng | 315/297 |

* cited by examiner

*Primary Examiner* — Douglas W Owens
*Assistant Examiner* — Jianzi Chen
(74) *Attorney, Agent, or Firm* — Thomas|Kayden

(57) ABSTRACT

An offline LED lighting circuit comprises a controller and a dimming circuit. The controller generates a switching signal to switch a transformer for generating an output voltage and an output current at an output terminal of the offline LED lighting circuit to drive LEDs. The dimming circuit is coupled to the controller to modulate the switching signal in response to a dimming signal. A first reference voltage and a second reference voltage of the controller are generated in response to the dimming signal. The switching signal is modulated by the first reference voltage and the second reference voltage. The controller regulates the output voltage at a first output level and a second output level in response to both the first reference voltage and the second reference voltage. The second output level is lower than the first output level.

10 Claims, 4 Drawing Sheets

OFFLINE LED LIGHTING CIRCUIT WITH DIMMING CONTROL

CROSS REFERENCE TO RELATED APPLICATIONS

The present application claims the benefit of U.S. provisional application entitled "Offline LED Lighting Circuit with Dimming Control", Ser. No. 61/276,676, filed Sep. 14, 2009.

BACKGROUND OF THE INVENTION

1. Field of the Invention

The present invention relates to lighting circuits, more particularly, the present invention relates to LED (Light Emitting Diode) lighting circuits.

2. Description of the Related Art

LEDs (Light Emitting Diodes) are recently replacing traditional incandescent and fluorescent illuminating devices as main lighting sources in many applications such as automobiles and home appliances because of their long lifespan, high optic efficiency, and low profile, etc.

Traditional arts of LED dimming control are generally achieved by adjusting the forward current flowing through the LED. Taking a white-light LED for instance, its color temperature will become lower when the forward current flowing through it becomes smaller than its regular forward current. The aforementioned color temperature variance is not desired by the industry. Therefore, there is a need to provide a LED dimming control with stable color temperature performance.

BRIEF SUMMARY OF THE INVENTION

An offline LED lighting circuit comprises a controller and a dimming circuit. The controller generates a switching signal to switch a transformer for generating an output voltage and an output current at an output terminal of the offline LED lighting circuit to drive LEDs. The dimming circuit is coupled to the controller to modulate the switching signal in response to a dimming signal. A first reference voltage and a second reference voltage of the controller are generated in response to the dimming signal. The switching signal is modulated by the first reference voltage and the second reference voltage. The controller regulates the output voltage at a first output level and a second output level in response to both the first reference voltage and the second reference voltage. The second output level is lower than the first output level.

The controller comprises a soft-start circuit to modulate the switching signal in response to the dimming signal. The switching signal will be generated in a soft-start manner when the output voltage changes from the second output level to the first output level. The dimming circuit further comprises an opto-coupler coupled to the controller. The controller comprises a voltage-feedback loop to regulate the output voltage and a current-feedback loop to regulate the output current. The output voltage is alternately regulated at the first output level and the second output level in response to the dimming signal. The output current is alternately regulated at a first current level and a second current level in response to the dimming signal. The first current level can be zero or a current level which causes an extremely low lumen. The second current level is set to drive the LEDs with a desired color temperature.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
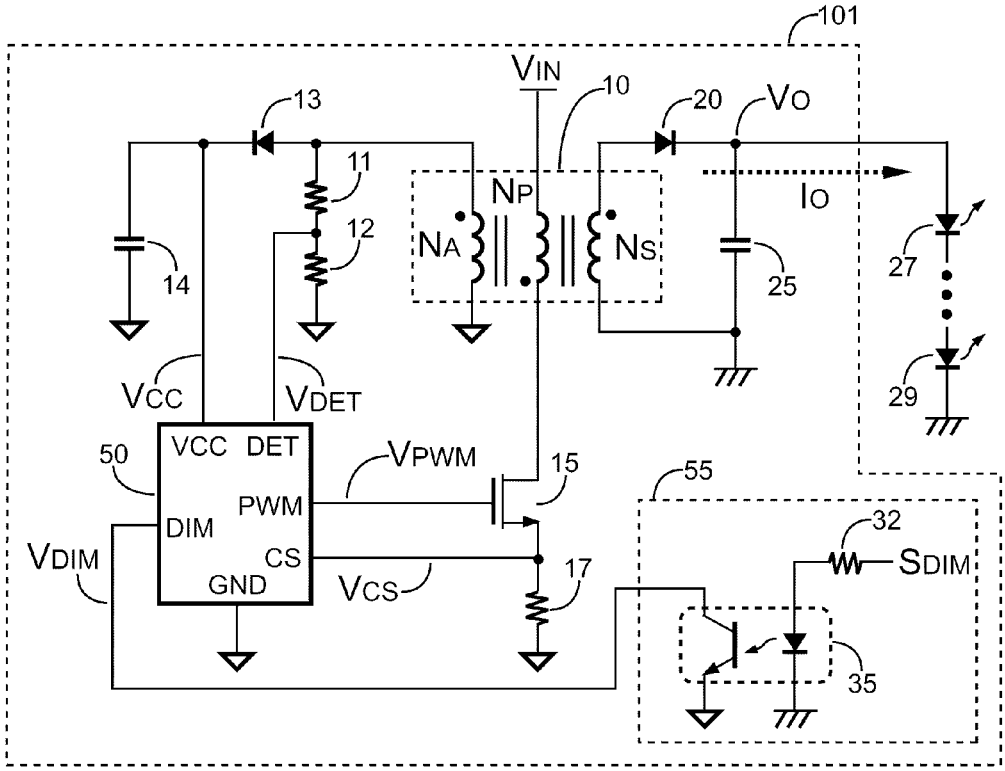
FIG. 1 shows an embodiment of an offline LED lighting circuit according to the present invention.

The present invention provides an offline LED (Light Emitting Diode) lighting circuit with dimming control. FIG. 1 shows an embodiment of the offline LED lighting circuit 101 according to the present invention. The offline LED lighting circuit 101 comprises a primary-side regulator and a dimming circuit 55. The primary-side regulator comprises a controller 50, a transformer 10, a transistor 15, rectifiers 13, 20, capacitors 14, 25, and resistors 11, 12, and 17. The dimming circuit 55 comprises a resistor 32 and an opto-coupler 35. A dimming signal $S_{DIM}$ controls an input of the opto-coupler 35 via the resistor 32. The offline LED lighting circuit 101 is utilized to drive LEDs 27~29 which are connected to each other in series.

The controller 50 generates a switching signal $V_{PWM}$ to switch the transformer 10 via the transistor 15. The controller 50 controls the primary-side regulator to provide an output voltage $V_O$ and an output current $I_O$ at an output terminal of the offline LED lighting circuit 101. More detailed description of the primary-side regulator can be found in U.S. Pat. No. 7,016,204 titled "Close-loop PWM Controller for Primary-side Controlled Power Converters"; U.S. Pat. No. 7,349,229 titled "Causal Sampling Circuit for Measuring Reflected Voltage and Demagnetizing Time of Transformer"; and U.S. Pat. No. 7,486,528 titled "Linear-predict Sampling for Measuring Demagnetized Voltage of Transformer". An output of the dimming circuit 55 is connected to an adjustment terminal DIM of the controller 50. An adjustment signal $V_{DIM}$ is obtained at the adjustment terminal DIM of the controller 50. The phases of the adjustment signal $V_{DIM}$ and the dimming signal $S_{DIM}$ are complementary. The duty cycle of the switching signal $V_{PWM}$ is therefore varied in response to the dimming signal $S_{DIM}$.

Figure 2:
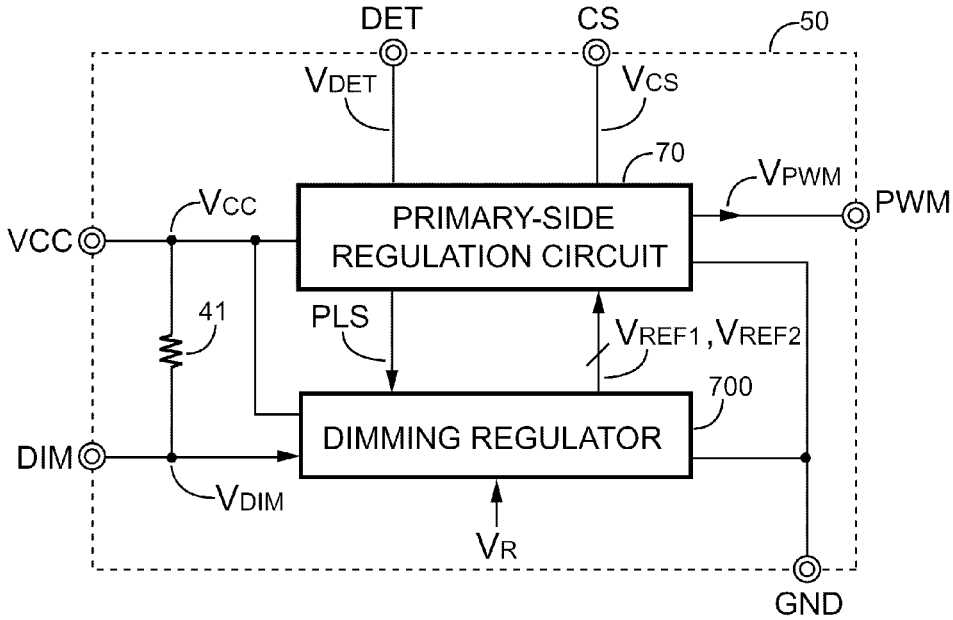
FIG. 2 shows an embodiment of a controller of the offline LED lighting circuit according to the present invention.

FIG. 2 shows an embodiment of the controller 50 according to the present invention. The controller 50 comprises a primary-side-regulation circuit 70, a dimming regulator 700, and a resistor 41. The primary-side regulation circuit 70 is coupled to receive a detection signal $V_{DET}$, a current-sense signal $V_{CS}$, a first reference voltage $V_{REF1}$, and a second reference voltage $V_{REF2}$ for generating the switching signal $V_{PWM}$. The first reference voltage $V_{REF1}$ and the second reference voltage $V_{REF2}$ of the controller 50 are generated in response to the adjustment signal $V_{DIM}$ which is phasecomplementary to the dimming signal $S_{DIM}$. The primary-side regulation circuit 70 further generates a pulse signal PLS. The resistor 41 is coupled to a supply source $V_{CC}$ to pull high the adjustment signal $V_{DIM}$ at the adjustment terminal DIM. The dimming regulator 700 receives the adjustment signal $V_{DIM}$, the pulse signal PLS, and a reference voltage $V_R$ to generate the first reference voltage $V_{REF1}$ and the second reference voltage $V_{REF2}$.

Figure 3:
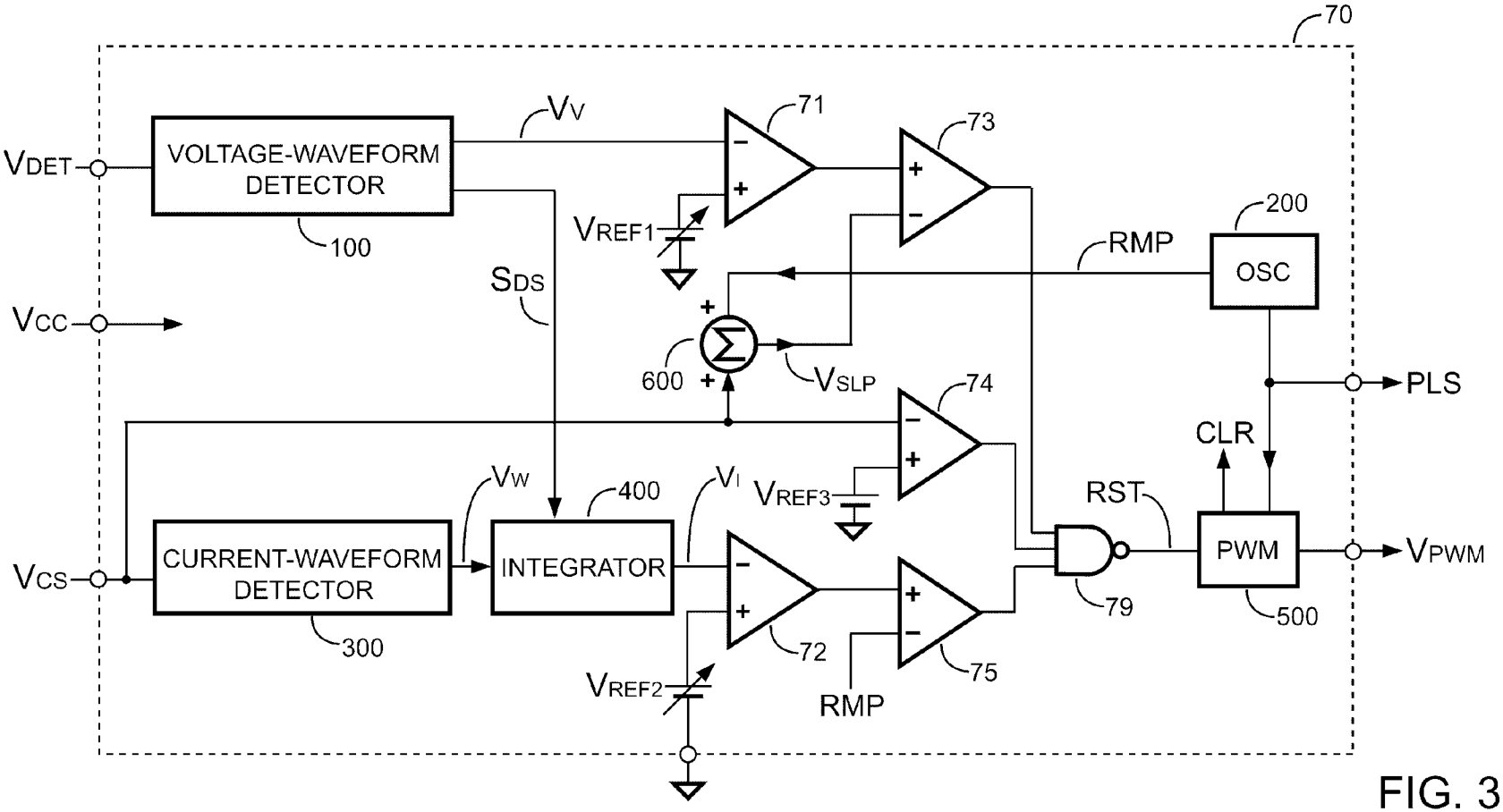
FIG. 3 shows an embodiment of a primary-side-regulation circuit of the controller according to the present invention.

FIG. 3 shows an embodiment of the primary-side-regulation circuit 70 according to the present invention. The primary-side-regulation circuit 70 of the controller 50 comprises a voltage-feedback loop and a current-feedback loop. The voltage-feedback loop includes the first reference voltage $V_{REF1}$ to regulate the output voltage $V_O$. The current-feedback loop includes the second reference voltage $V_{REF2}$ to regulate the output current $I_O$. The second reference voltage $V_{REF2}$ also regulates the output voltage $V_O$. Detailed theory and circuit operation of the primary-side-regulation circuit 70 can also be found in the U.S. Pat. No. 7,016,204 titled "Close-loop PWM controller for primary-side controlled power converters" and will be omitted herein.

Figure 4:
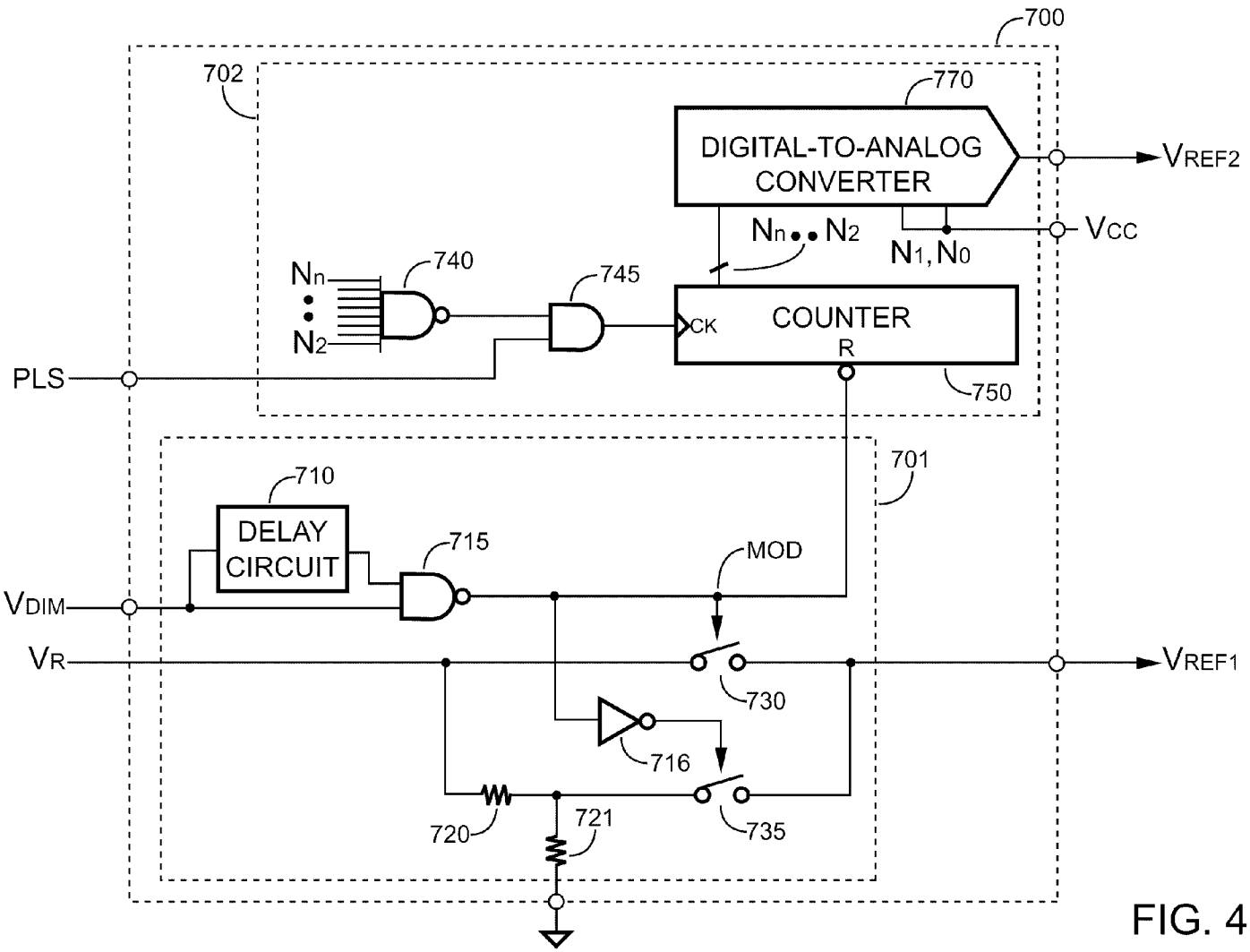
FIG. 4 shows an embodiment of a dimming regulator of the controller according to the present invention.

FIG. 4 shows an embodiment of the dimming regulator 700 according to the present invention. The dimming regulator 700 comprises a voltage-multiplexer 701 and a soft-start circuit 702. The voltage-multiplexer 701 comprises a delay circuit 710, a NAND gate 715, an inverter 716, switches 730 and 735, and a voltage divider. A first input of the NAND gate 715 is supplied with the adjustment signal $V_{DIM}$. A second input of the NAND gate 715 is supplied with the adjustment signal $V_{DIM}$ via the delay circuit 710. An output terminal of the NAND gate 715 generates a soft-start signal MOD. The voltage divider is formed by connecting a resistor 720 and a resistor 721 in series. The reference voltage $V_R$ is supplied to a first terminal of the switch 730 and a first terminal of the resistor 720. A second terminal of the resistor 720 is connected to a first terminal of the resistor 721. A second terminal of the resistor 721 is connected to a primary ground reference. The second terminal of the resistor 720 is also connected to a first terminal of the switch 735. A control terminal of the switch 730 is supplied with the soft-start signal MOD. A control terminal of the switch 735 is supplied with the soft-start signal MOD via the inverter 716. The delay circuit 710 and the NAND gate 715 provide de-bounce operation for generating the soft-start signal MOD in response to the adjustment signal $V_{DIM}$. A second terminal of the switch 730 and a second terminal of the switch 735 are connected to each other to generate the first reference voltage $V_{REF1}$. The first reference voltage $V_{REF1}$ varies in response to the state of the soft-start signal MOD.

As the adjustment signal $V_{DIM}$ becomes logic-low, the soft-start signal MOD will soon turn to logic-high. The switch 730 is turned on, and the first reference voltage $V_{REF1}$ can be therefore expressed by the following equation:

$$V_{REF1}=V_r \tag{1}$$

where $V_r$ represents the value of the reference voltage $V_R$ in the controller 50.

As the adjustment signal $V_{DIM}$ becomes logic-high, the soft-start signal MOD will turn to logic-low after a delay time provided by the delay circuit 710. The switch 735 is turned on and the first reference voltage $V_{REF1}$ can be therefore expressed by the following equation:

$$V_{REF1} = V_r \times \frac{R_{721}}{R_{720} + R_{721}} \tag{2}$$

where $R_{720}$ and $R_{721}$ respectively represent the resistance of the resistors 720 and 721.

The soft-start circuit 702 comprises a NAND gate 740, an AND gate 745, a counter 750, and a digital-to-analog converter 770. The counter 750 generates digital signals $N_n \ldots N_2$ in response to the pulse signal PLS. The digital-to-analog converter 770 has inputs for receiving digital signals $N_n \ldots N_2$. The digital-to-analog converter 770 further has digital inputs for receiving digital signals $N_1$ and $N_0$ which are both connected to the supply source $V_{CC}$ (logic-high). The digital signal $N_n$ is the most significant bit and the digital signal $N_0$ is the least significant bit. The value of the second reference voltage $V_{REF2}$ generated by the digital-to-analog converter 770 is converted from the digital signals $N_n \ldots N_0$. Inputs of the NAND gate 740 also receive the digital signals $N_n \ldots N_2$. An output of the NAND gate 740 is connected to a first input of the AND gate 745. A second input of the AND gate 745 is supplied with the pulse signal PLS. The soft-start signal MOD is supplied to a reset input of the counter 750. When the soft-start signal MOD becomes logic-low, outputs of the counter 750 will be cleared. The second reference voltage $V_{REF2}$ will maintain at a minimum value which is determined by the digital signals $N_1$ and $N_0$ supplied to the digital-to-analog converter 770. When the soft-start signal MOD becomes logic-high, the counter 750 will start to count upward in response to the pulse signal PLS. The outputs of the counter 750 will continue to count upward until each output thereof becomes logic-high. During this period, the second reference voltage $V_{REF2}$ gradually increases from the minimum value to a maximum value. The maximum value of the second reference voltage $V_{REF2}$ is obtained when digital signals $N_n$ $N_0$ are all logic-high.

Therefore, the soft-start circuit 702 will modulate the switching signal $V_{PWM}$ in response to the second reference voltage $V_{REF2}$. The duty cycle of the switching signal $V_{PWM}$ will begin to expand in a soft-start manner at the moment that the adjustment signal $V_{DIM}$ changes from logic-high state to logic-low state. The switching signal $V_{PWM}$ and the output current $I_O$ will be generated in the soft-start manner when the output voltage $V_O$ changes from a second output level $V_{O2}$ to a first output level $V_{O1}$.

Figure 5:
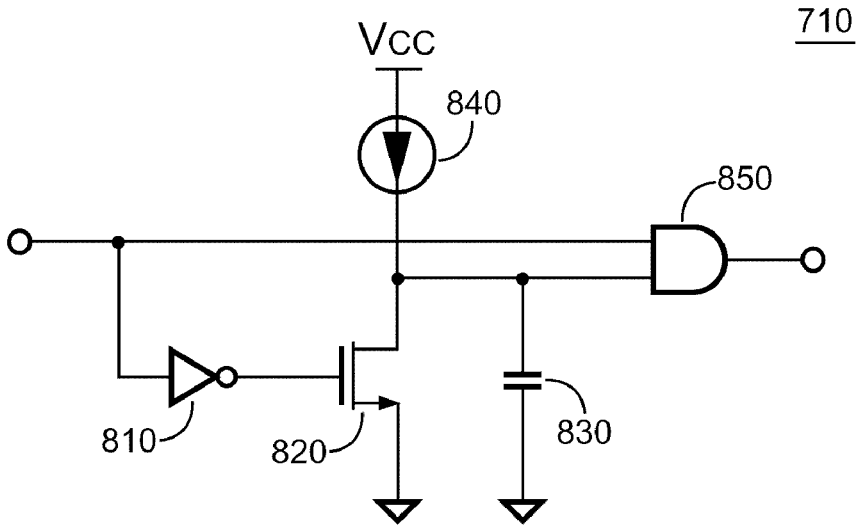
FIG. 5 shows an embodiment of a delay circuit of the dimming regulator according to the present invention.

FIG. 5 shows an embodiment of the delay circuit 710 according to the present invention. The delay circuit 710 comprises a current source 840, an inverter 810, a transistor 820, a capacitor 830, and an AND gates 850. An input terminal of the delay circuit 710 is connected to an input of the inverter 810 and a first input of the AND gate 850. An output of the inverter 810 is connected to a gate of the transistor 820. A drain of the transistor 820 is connected to a second input of the AND gate 850. The current source 840 is connected between the supply source $V_{CC}$ and the drain of the transistor 820. A source of the transistor 820 is connected to the primary ground reference. The capacitor 830 is connected between the drain of the transistor 820 and the primary ground reference. An output of the AND gate 850 is connected to an output terminal of the delay circuit 710 for generating a delayed signal. Therefore, the delay circuit 710 receives an input signal to generate the delayed signal after the delay time. The delay time of the delay circuit 710 is determined by the current magnitude of the current source 840 and the capacitance of the capacitor 830.

Figure 6:
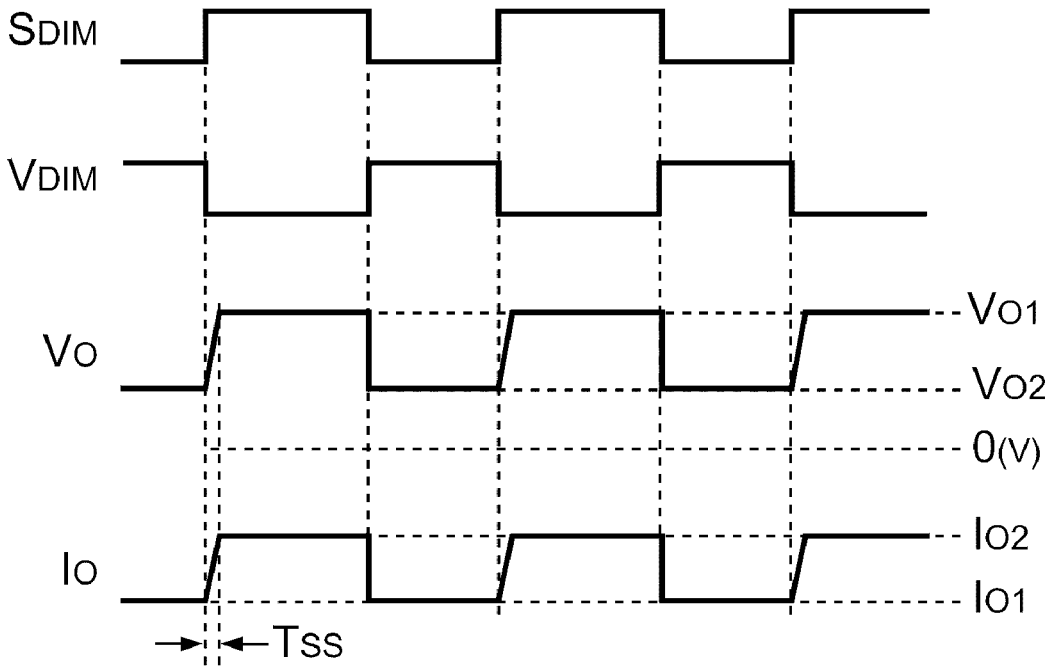
FIG. 6 shows key waveforms of the present invention.

FIG. 6 shows key waveforms of the present invention. Referring to FIG. 1 and FIG. 6, when the dimming signal $S_{DIM}$ becomes logic-low, the adjustment signal $V_{DIM}$ will become logic-high in response thereto. The output voltage $V_O$ will be regulated at a second output level $V_{O2}$ in accordance with the logic-high state of the adjustment signal $V_{DIM}$. The second output level $V_{O2}$ of the output voltage $V_O$ is a predetermined level that is just lower than a summed forward voltage of series connected LEDs 27~29. As the second output level $V_{O2}$ of the output voltage $V_O$ is generated at the output terminal of the offline LED lighting circuit 101, the LEDs 27~29 will be all turned off. The second output level $V_{O2}$ can be expressed by the following equation:

$$V_{O2} = \frac{R_{11} + R_{12}}{R_{12}} \times n \times V_r \times \frac{R_{721}}{R_{720} + R_{721}} \tag{3}$$

where $R_{11}$, $R_{12}$, $R_{720}$, and $R_{721}$ respectively represent resistance of resistors 11, 12 720, and 721; $V_r$ represents the value of the reference signal $V_R$ in the controller 50; n represents the turn-ratio of the transformer 10.

When the dimming signal $S_{DIM}$ becomes logic-high, the adjustment signal $V_{DIM}$ will become logic-low in response thereto. The output voltage $V_O$ will be regulated at a first output level $V_{O1}$ in accordance with the logic-low state of the adjustment signal $V_{DIM}$. The first output level $V_{O1}$ of the output voltage $V_O$ is a predetermined level that is just higher than a summed forward voltage of series connected LEDs 27~29. As the first output level $V_{O1}$ of the output voltage $V_O$ is generated at the output terminal of the offline LED lighting circuit 101, the LEDs 27~29 will be all turned on. The first output level $V_{O1}$ can be expressed by the following equation:

$$V_{O1} = \frac{R_{11} + R_{12}}{R_{12}} \times n \times V_r \tag{4}$$

The first output level $V_{O1}$ is greater than the second output level $V_{O2}$. The output voltage $V_O$ is alternately switched between the first output level $V_{O1}$ and the second output level $V_{O2}$ in response to the dimming signal $S_{DIM}$. The output current $I_O$ is also alternately switched between a first current level $I_{O1}$ and a second current level $I_{O2}$ in response to the dimming signal $S_{DIM}$. The first current level $I_{O1}$ can be zero or a current level which causes an extremely low lumen. The second current level $I_{O2}$ is set to drive the LEDs with a desired color temperature. The controller 50 regulates the output voltage $V_O$ at the first output level $V_{O1}$ and the second output level $V_{O2}$ in response to both the first reference voltage $V_{REF1}$ and the second reference voltage $V_{REF2}$. A period that the output voltage $V_O$ ramps up from the second output level $V_{O2}$ to the first output level $V_{O1}$ is equal to a period that the output current $I_O$ ramps up from the first current level $I_{O1}$ to the second current level $I_{O2}$. In response to the adjustment signal $V_{DIM}$, the dimming regulator 700 results in an increment of the output current $I_O$ in the soft-start manner during the aforementioned period, which is denoted by $T_{SS}$ in FIG. 6.

As the embodiment described above, the offline LED lighting circuit of the present invention utilizes a PWM modulated dimming signal to alternately regulate the output voltage $V_O$ between two output levels and alternately regulate the output current $I_O$ between two current levels for achieving LED dimming control with stable color temperature performance.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An offline light emitting diode (LED) lighting circuit comprising:

a controller, generating a switching signal to switch a transformer for generating an output voltage and an output current at an output terminal of said offline LED lighting circuit to drive LEDs; and a dimming circuit, coupled to said controller to modulate said switching signal in response to a dimming signal;

wherein a first reference voltage and a second reference voltage of said controller are generated in response to said dimming signal, and said switching signal is modulated by said first reference voltage and said second reference voltage; and wherein said controller regulates said output voltage at a first output level and a second output level in response to both said first reference voltage and said second reference voltage.

2. The offline LED lighting circuit as claimed in claim 1, wherein said second output level is lower than said first output level.

3. The offline LED lighting circuit as claimed in claim 1, wherein said controller comprises a soft-start circuit to modulate said switching signal in response to said dimming signal, and said switching signal is generated in a soft-start manner when said output voltage changes from said second output level to said first output level.

4. The offline LED lighting circuit as claimed in claim 1, wherein said dimming circuit further comprises an opto-coupler coupled to said controller.

5. The offline LED lighting circuit as claimed in claim 1, wherein said controller comprises a voltage-feedback loop to regulate said output voltage and a current-feedback loop to regulate said output current.

6. The offline LED lighting circuit as claimed in claim 1, wherein said output voltage is alternately regulated at said first output level and said second output level in response to said dimming signal.

7. The offline LED lighting circuit as claimed in claim 1, wherein said output current is alternately regulated at a first current level and a second current level in response to said dimming signal.

8. The offline LED lighting circuit as claimed in claim 7, wherein said first current level is zero.

9. The offline LED lighting circuit as claimed in claim 7, wherein said first current level is a current level which causes an extremely low lumen.

10. The offline LED lighting circuit as claimed in claim 7, wherein said second current level is set to drive the LEDs with a desired color temperature.

* * * * *